US005655450A

United States Patent [19]

Hermannn

[11] Patent Number: 5,655,450

[45] Date of Patent: Aug. 12, 1997

[54] APPARATUS FOR THE PRINTING AND/OR DISPENSING OF LABELS

[76] Inventor: Klaus Dieter Hermannn, Krautlachenweg 7, 69434 Hirschhorn, Germany

[21] Appl. No.: 538,524

[22] Filed: Oct. 3, 1995

[30] Foreign Application Priority Data

Oct. 4, 1994 [DE] Germany ..... 44 35 467.3

[51] Int. Cl.[6] ..... B41F 1/08

[52] U.S. Cl. ..... 101/288; 156/384

[58] Field of Search ..... 101/228, 287, 101/288, 292; 156/384, 541, 387, 579

[56] References Cited

U.S. PATENT DOCUMENTS

| | | | |
|---|---|---|---|
| 3,782,279 | 1/1974 | Victor et al. | 101/288 |
| 4,075,944 | 2/1978 | Conley | 101/288 |
| 4,125,074 | 11/1978 | Sato | 101/288 |
| 4,176,603 | 12/1979 | Sato | 101/291 |
| 4,369,085 | 1/1983 | Hermann | 101/288 |
| 4,377,435 | 3/1983 | Fujita | 156/384 |
| 4,830,522 | 5/1989 | Sato et al. | 101/288 |
| 5,258,090 | 11/1993 | Becker et al. | 101/288 |

FOREIGN PATENT DOCUMENTS

| | | |
|---|---|---|
| 0039803 | 11/1981 | European Pat. Off. . |
| 0115581 | 8/1984 | European Pat. Off. . |
| 2638441 | 11/1977 | Germany . |
| 3051125 | 11/1981 | Germany . |
| 4126526 | 2/1993 | Germany . |

*Primary Examiner*—Ren Yan

*Attorney, Agent, or Firm*—Walter A. Hackler

[57] ABSTRACT

The invention concerns an apparatus for the printing and/or dispensing of labels having a transport device for a label tape which is guided from a supply roller around a deflection edge for separating the label from its carrier band to a transport wheel at which a driver, driven in a stepwise fashion by a hand lever, engages. In accordance with the invention a connecting means (29) is pivotably mounted about the axis (24) of the transport wheel (7) which exhibits, on its periphery, resilient catches (42) which, in the drive direction of the transport wheel (7), interlockingly engage in corresponding recesses (43) of the transport wheel (7) only in the rotational direction and, on the connecting means (29), at least one pin (28) projecting outwardly and parallel to the pivot axis is provided for whose radial separation from the axis (37) of the transport wheel (7) is smaller than the radius of the transport wheel (7) and which cooperates with the driver (27) driven by the hand lever (4).

15 Claims, 3 Drawing Sheets

APPARATUS FOR THE PRINTING AND/OR DISPENSING OF LABELS

BACKGROUND OF THE INVENTION

The invention concerns an apparatus for the printing and/or dispensing of labels having a transport device for a label band which is guided from a supply roller around a deflection edge for detachment of the label from its carrier band to a transport wheel engaged by a driver driven in a stepwise fashion by a hand-operated lever, for example, in accordance with EP 00 39 803.

The labels are usually arranged on the carrier band separated from each other with cuts. In order to print as well as to dispense the labels for labeling an object, it is necessary that the carrier band be transported through a transport step having sufficient extent that, in each case, a label becomes detached at the deflection edge from the carrier band and, for example, comes to rest beneath a pressure roller of the device with which the label can be pressed onto a surface. The length by which the carrier band is transported during a transport step must therefore precisely coincide with the length of the label so that, at the deflection edge, the label is always in the same position (dispensing position). In practical applications however, depending on the size of the print on the label or for other reasons, labels of differing lengths are necessary. The user therefore has access to rolls of label bands with which each label has a particular length but with the length of the labels from one label roll to another label roll possibly being different. In order to avoid the necessity of maintaining a separate labelling device adapted to each particular label length, one had provided the conventional devices with an exchangeable device floor, whereby each device floor is provided with a transport device adapted to the corresponding label length so that, when changing the label size, it is only necessary for the corresponding label roll to be introduced into the apparatus and a device floor is introduced into the apparatus whose transport mechanism is adapted to the label to be processed. Towards this end, it is desirable for different transport devices adapted for the production of different sized transport steps to utilize as many of the same parts of the transport device as possible. The various transport devices having exchangeable device floors which can be utilized in one and the same device, have substantial limitations on the size of the transport wheel. If, for a fixed size of the transport wheel, that is to say with transport wheels of approximately the same perimeter, it is intended to produce differing sized transport steps, it is necessary for differing lengths of the transport step to be correlated to differing rotational angles of the transport wheel—with small labels and correspondingly small transport steps, the transport wheel is rotated by only a small rotational angle and with longer labels it is, however, necessary for the corresponding rotational angle of the transport wheel during a transport step to be correspondingly larger. The transport devices however, in conventional devices, for example, in accordance with EP 00 39 803 are driven by a hand-operated lever whose pivot angle cannot deviate substantially from the size found in practical applications to be optimal so that transport devices associated with transport steps of different lengths must be driven by a motion which is derived from the same hand-lever motion.

In order to solve this problem it is known in the art from EP 00 34 579 to insert a device in the power train between the hand-lever and the transport wheel which transforms the motion derived from the hand lever into a relatively large rotational angle of the transport wheel. This device exhibits a toothed segment driven by the hand lever via an intermediate lever which engages a cogged wheel connected to a coupling member which, in turn, engages the transport wheel. This drive mechanism is extremely difficult and is not easily reconfigured to a differing transport step.

In contrast thereto it is the purpose of the invention to develop as simple a construction as possible with which, for example, the simple transport device of the apparatus according to EP 00 39 803 can be reconfigured for different label lengths; that is to say, with a device with which a driver, which is driven in a stepwise fashion by a hand-lever, engages a transport wheel.

SUMMARY OF THE INVENTION

This purpose is achieved in accordance with the invention in that a connecting means is pivotably mounted about the axis of the transport wheel which exhibits resilient catches around its periphery which engage in the drive direction of the transport wheel in associated recesses to interlockingly transfer the drive force only in the rotational direction of the transport wheel and, on the connecting means, at least one outwardly projecting pin parallel to the rotational axis is provided for whose radial separation from the axis is smaller than the radius of the transport wheel and which cooperates with the driver driven by the hand lever. To reconfigure the device for the processing of label rolls having different label lengths it is therefore only necessary for the connecting means to be exchanged by another connecting means with which the pin at which the driver engages exhibits a different separation from the rotational axis.

In embodiments of the invention the radial separation of pins cooperating with the driver from the axis of the transport wheel is approximately half the radial separation to the perimeter of the transport wheel.

In embodiments of the invention, it is possible to provide for a plurality of pins on the connecting means which cooperate with the driver so that, as is known in the art from EP 00 39 803, the driver, during its back and forth motion, engages a pin to forwardly rotate the connecting means by a particular angle, returns, however, to its original position without engaging this pin and, in its subsequent forward motion, engages the next pin to forwardly drive the transport wheel via the connecting means through the subsequent transport step. In this case it is possible for the catching heads of the connecting means which engage at the perimeter of the transport wheel, to engage in a sufficiently secure fashion that they remain in these catches along a particular length during processing of the labels and only when exchanging the connecting means do the catching heads leave the catch recesses of the transport wheel.

In other embodiments of the invention however the catching heads of the connecting means are arranged on arms which resiliently press these catch heads into the recesses on the transport wheel. In this fashion one can construct a drive for the transport device in such a fashion that the catch heads leave the catch recesses following each transport step to enter into the neighbouring catch recess.

This embodiment of the invention can be further improved in such a manner that the end of the driver facing away from the hand lever only catchingly engages at one pin of the connecting means which projects parallel to the axis of the transport wheel in the outer direction, whereby this catching connection is only released when exchanging the connecting means. The connecting means are then driven by the driver into a back and forth motion. This embodiment of the invention can be further configured in such a fashion that, as is known in the art, a reverse motion catch engages the transport wheel to firmly hold the transport wheel during the return motion of the driver and thereby during the reverse rotation of the connecting means. During this reverse rotation of the connecting means the catch heads leave the catch recesses in opposition to their spring force and, at the end of the reverse motion of the connecting means, snap into neighbouring catches.

In embodiments of the invention, towards this end, the resiliency of the catch heads is realized in that the arms supporting the catch heads run diagonally from a middle piece of the connecting means outwardly in the rotational direction of the transport wheel so that, when the connecting means rotates in the transport direction, the arms further rotate the transport wheel by one step via the catch heads, since the arms exercise a force which is largely directed along their axis at the edge of the catch recess, and, during reverse rotation of the connecting means, the catch heads however, in consequence of an action which is comparable to that of a leaf spring, springingly leave the catch recesses.

With this constructional form, the connecting means is likewise driven back and forth by the back and forth driver via the catch connection of the driver with the connecting means.

In embodiments of the invention with which the transport wheel is rotatably mounted in the floor portion of the device, in particular with embodiments with which this device floor portion is mounted in such a fashion that it can be pivoted away from the housing, a flap is pivotably mounted in the device floor which covers the transport wheel approximately in the lower plane of the housing. By swinging open the flap one can gain good access to the periphery of the transport wheel for purposes of cleaning the periphery or to remove support band or label pieces which have become stuck thereto.

A guide roller for the support band can be arranged around the pivot axis of the flap with which the support band can be directed to the periphery of the transport wheel at which the carrier band can be transported without slippage by pins or similar cooperating members projecting radially out of the periphery which engage the carrier band in, for example, recesses or cuts provided therein.

The flap, including if appropriate the guide roller, can, in embodiments of the invention, be mounted in the device floor in a removable fashion. In this manner a very simple construction of the apparatus is possible which can be easily disassembled into its individual parts and reassembled.

In embodiments of the invention, the flap exhibits a reverse motion catch for the transport wheel configured in the manner of a leaf spring on its side facing the transport wheel which cooperates with projections on the transport wheel. In this fashion the reverse motion catch can be particularly easily configured in the device.

Finally, in embodiments of the invention, the flap can exhibit a projection for engagement into the periphery of the transport wheel and serving as paper rejector which preferentially engages into a groove fashioned on the periphery of the transport wheel to lift the carrier band from the periphery of the transport wheel.

In embodiments of the invention, the flap can exhibit teeth on its free end for tearing off the carrier band and can exhibit, in particular on its side edges, a resilient catch which firmly holds the flap in its closed position in the device floor.

Further features of the invention can be derived from the following description of an embodiment of the invention in connection with the claims and the drawing. The individual features can be utilized in embodiments of the invention individually or collectively.

The drawings show significant parts of an embodiment of the invention for purposes of clarification of the invention.

DESCRIPTION OF THE PREFERRED EMBODIMENT

Figure 1:
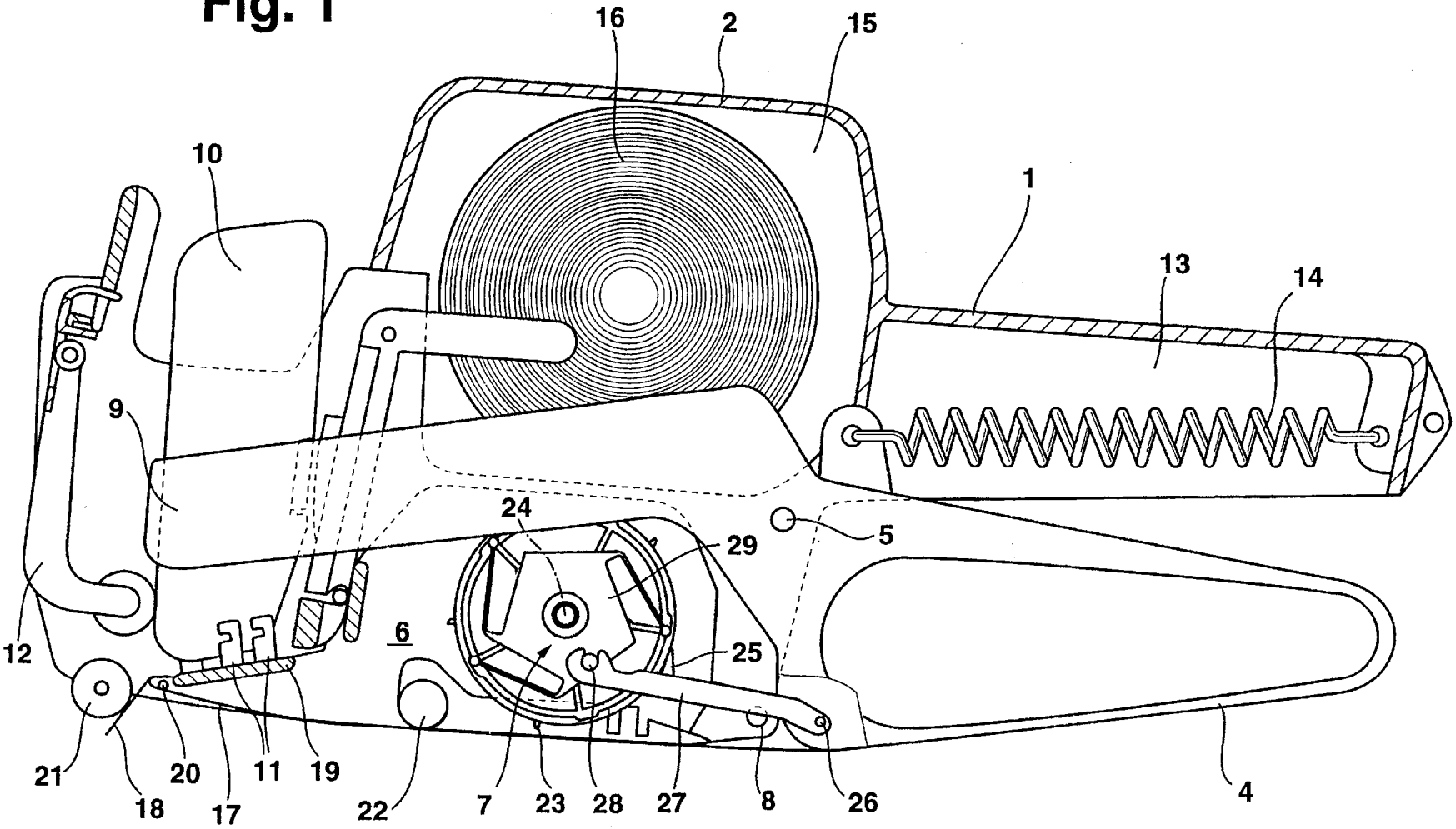
FIG. 1 shows a cut through the device with a hand lever cocked against the spring action.

In the embodiment of the invention represented in the drawing, a housing 1 exhibits two plates whose borders are recognizable in FIG. 1 which are parallel to the plane of the drawing and which are rigidly connected to each other by means of transverse walls 2, represented in FIG. 1 with dashed lines, as well as with a strut, whereby the housing 1 has an approximately U-shaped cross-section and is preferentially extruded from plastic into a single piece. A likewise preferentially single component hand operation lever 4 is pivotably mounted in the housing about an axle bolt 5 and a device floor 6 having a transport device is pivotably mounted about axle bolt 8. A printing unit 10 is attached at an extension 9 of the hand lever 4 whose printing types 11 can be inked by an inking device 12 which is pivotably mounted in the housing.

A spring 14 is provided for in the hollow handle 13 which attempts to pivot the hand lever 4 in a clock-wise direction about the pivot axis 5. A label roll 16 is located in a hollow chamber 15 of the housing whose label band exhibits a carrier band 17 upon which individual labels 18 separated from each other by means of separating cuts, are mounted. The label band is guided over a counter-pressure plate 19 to a deflection edge 20 where, in the position shown in FIG. 1, the labels 18 separate from the carrier band to be positioned below a press roller 21 which is rotatably mounted in the device housing 1 and which, when placing the device on a surface, presses and, when pulling back the device, rolls the label 18 onto the surface to completely separate it from the carrier band 17. Before the label 18 is completely separated from the carrier band 17 at the deflection edge 20, it is provided with a selectable print which is adjustable in the print unit via the printing type 11 at the strut configured in a manner of a counter-pressure plate 19.

The carrier band 17 is guided by the deflector edge 20, arranged in the device floor 6, over a roller 22 pivotably mounted in the device floor around a periphery of a transport wheel 7 of the transport device and is met therein by radially protruding pins 23 which engage into openings or slots in the carrier band. During the stepwise rotation of the transport wheel 7 about its axle 24 mounted in the device floor 6, these pins carry the carrier band in an interlocking and slip-free fashion. A paper rejector 25 then lifts the carrier band from the periphery of the transport wheel 7 and it subsequently exits below out of the device.

A driver 27 is hinged to the hand lever 4 and is mounted in a pivotable fashion about its axle bolt 26, the front end of the driver 27 engaging a pin 28 of a connecting means 29 which projects outwardly axially parallel to the axle 24.

In the event that the hand lever 4 is pulled in opposition to the action of the spring 14, the printing unit moves from a raised position in the downward direction and presses against the label of the label band located on the counter-pressure plate 19. At the same time, the driver 27 is pulled back and the connecting means 29 exercises a neutral step in the counter-clockwise direction with which it does not transport the transport wheel, since same is held by a reverse motion catch 29 arranged in a flap 30 which, for its part, is pivotably mounted in a removable fashion to the device floor about axle bolt 31 or at the ends of a continuous axle pin.

In the event that the hand lever 4 is released by the operator's hand, the spring 14 pivots the hand lever 4 about the axis 5 in a clockwise direction and the printing unit 10 is lifted away from the strut configured as a counter-pressure plate 19. At the same time the driver 27 is pushed forward to rotate the connecting means 29 via the pin 28 by a transport step in a clockwise direction. In the course of this rotation, the connecting means 29 drives the transport wheel 7 and the carrier tape 17 is transported via the pins 23 by the length of a label so that the label 18 which had previously been printed at the counter-pressure plate 19 travels underneath the press roller 21 into the dispensing position. The dimensions can be choosen in such a fashion that, in this resting position, the pivot axis 26 of the driver 17 is flush with the pivot axis 8 of the device floor in the housing.

Figure 8:
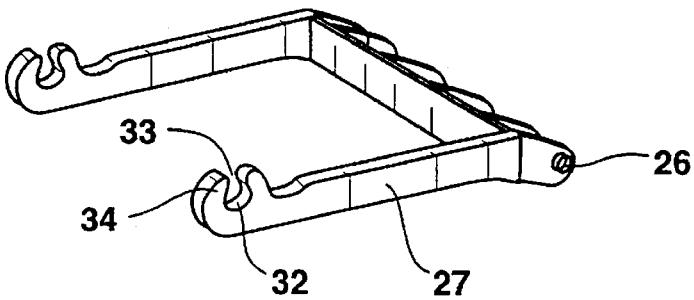
FIG. 8 shows a driver for driving the connecting means.

The device floor 6 engages, with its sidewardly protruding axle bolt 8, into openings in the side plates of the housing 1. In the event that the device floor 6 is removed from the housing, both side plates of the housing are spread somewhat apart so that the axle bolts 8 are removed from the corresponding recesses in the side plates of the device. In a similar manner the driver 27 is pivotably mounted about the axle bolt 26 in the hand lever 4. By widening the side walls of the hand lever 4, it is possible to remove the driver 27 from the hand lever 4. The driver 27 exhibits openings 32 on the front end of both its arms within which a pin 28 of the connecting means 29 is guided. The openings 32 could be open towards one side and the wall 34 defining the slots 33 can be resilient so that, if necessary, the bolt 28 can be removed in a snap-like manner from the opening 32 in the upward direction of FIG. 8 or the arms of the driver 27 could be resiliently bent in the outward direction so that the bolt 28 could likewise be removed from the opening 32.

It is also possible to spread the side components 35 of the device floor 6 sufficiently far apart that the axle bolt 31 of the flap 30 is removed from its pivoting position in the side components 35 so that the flap 30 can be removed from the device floor 6.

Figure 3:
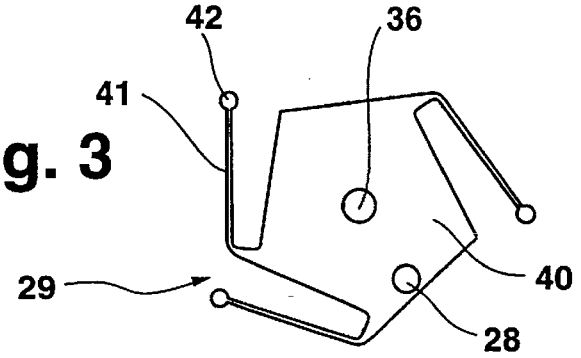
FIG. 3 shows an embodiment of a connecting means.
Figure 4:
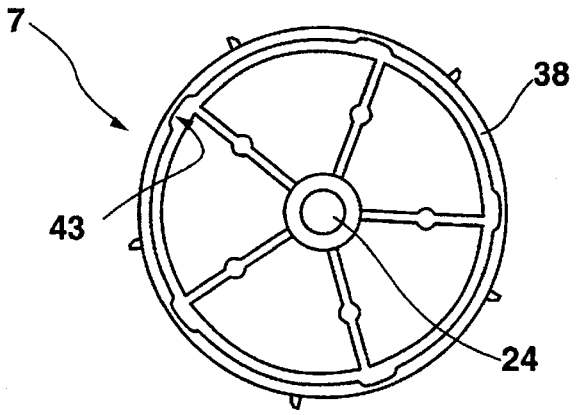
FIG. 4 shows the transport wheel as seen from the front side.
Figure 5:
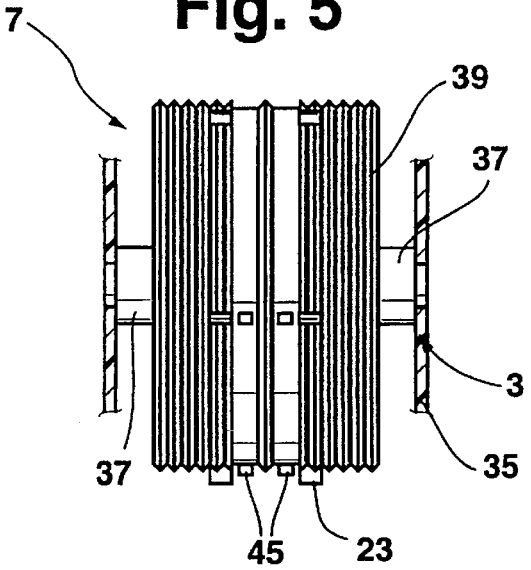
FIG. 5 shows the transport wheel as seen at the periphery.
Figure 6:
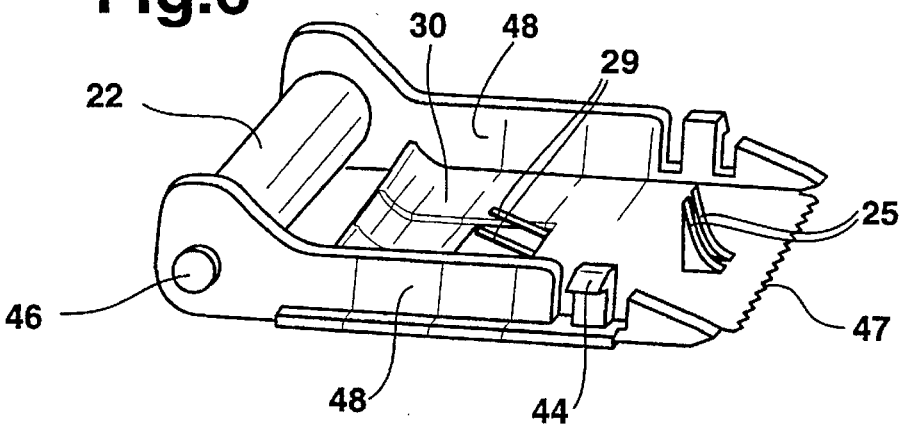
FIG. 6 shows an embodiment of the flap utilized in the represented embodiment of the device.
Figure 7:
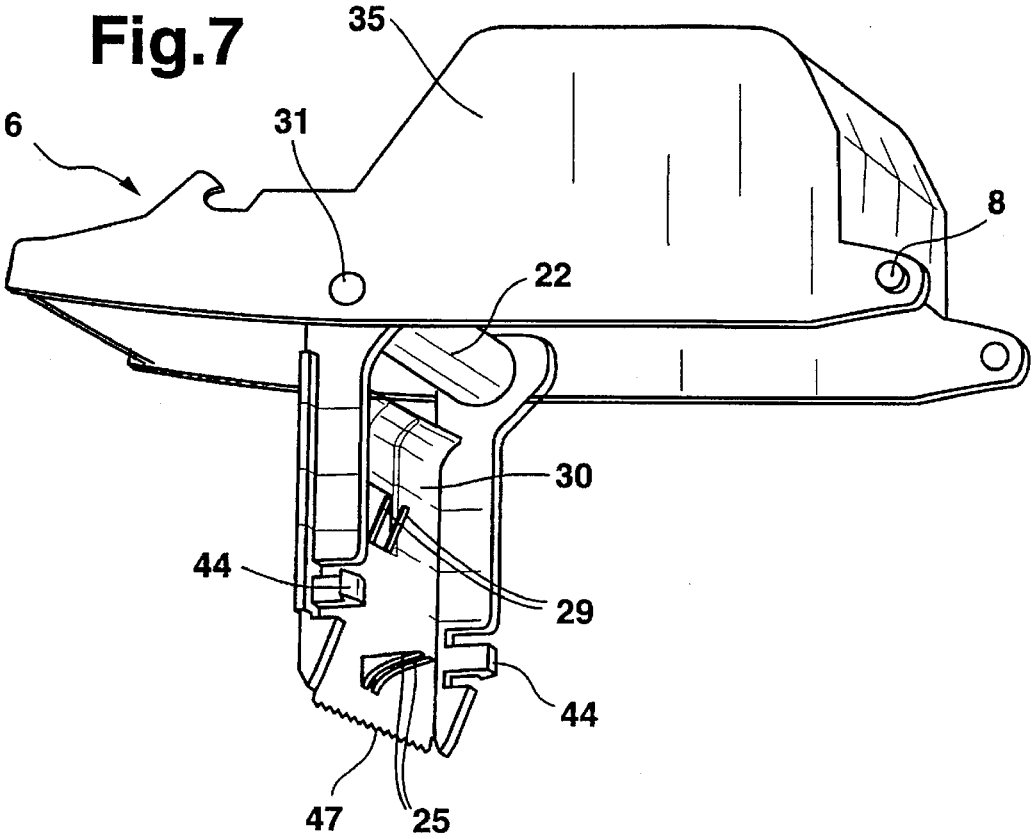
FIG. 7 shows this flap in its configuration at a device floor portion.

The connecting means 29 shown in FIG. 3 exhibits a central bore 36 with which one connecting means 29 is mounted to each axle bolt 37 of the axle 24 at both sides of the transport wheel 7. The axle bolts 37 extend along the axis of the transport wheel 7, penetrate through the bores 36 in the connecting means 29 and are mounted in rotation mounts 3 (FIG. 5) of the side components 35 of the device floor 6. A hollow region 39 is located on the front sides of the transport wheel 7 surrounded by jacket 38 of the transport wheel 7 which completely accepts the connecting means 29 when same is pushed onto the axle bolt 37.

Figure 2:
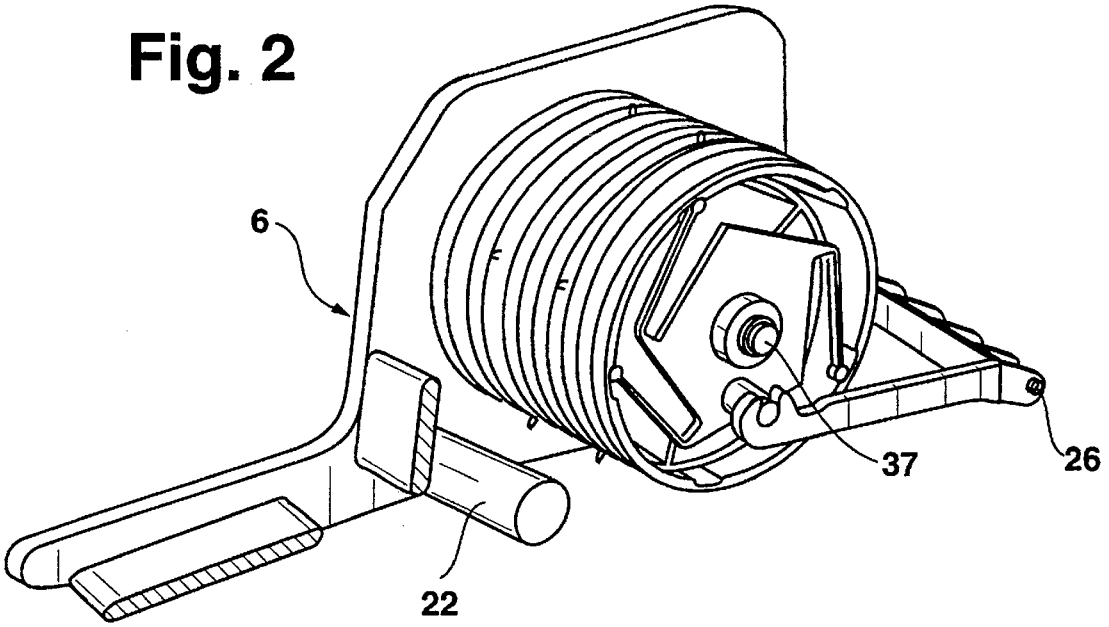
FIG. 2 shows a view of the removed device floor with broken-away front wall.

The connecting means 29 exhibit a middle piece 40 having three extruded arms 41 in the embodiment represented which support catch heads 42 on their front ends. The arms 41 run from middle piece 40 diagonally outwardly and in the transport direction of the transport wheel 7 when they are pushed onto the axle bolt 37 in such a fashion that the pin 28 points outwardly. The catch heads 42 engage catch recesses 43 at the inner side of the jacket 38 of the transport wheel 7 to drive the transport wheel 7 during rotation in the clockwise direction (FIGS. 2 and 3) by one transport step exercised by the driver 27 on the pin 28. However, in the event that the driver 27 moves when squeezing the hand lever 4 against the spring action 14, the catch heads 42 leave the catch recesses 43, since the transport wheel 7 is held by the reverse motion catch 29 and then engage by virtue of the outwardly directed spring action of the arms 41 into the next catch recess 43.

In the embodiment shown, the connecting means 29 exhibits only three arms 41 with catch heads 42. These arms are, however, arranged on the middle piece 40 in a manner defining a five-fold division, and if necessary, connecting means 29 having four, five or less arms can be utilized to which the distribution of the catch recesses 43 is matched as in the connecting means having only three arms 41 represented in FIG. 3. The number of arms 41 with catch heads 42 depends upon the force which must be exercised on the hand lever in order to pull the arms of the catch heads out of the recesses against the spring action of the arms and should not exceed a certain amount.

The flap 30 exhibits an approximately U-shaped cross-section with short legs and resilient catches 44 are provided on the side walls 48 of the flap which, when the flap is folded into the device floor 6, engage into corresponding snap projections arranged in the device floor 6. The reverse motion catch 29 provided for on the flap exhibits arms working in the manner of leaf springs which cooperate with projections 45 on the periphery of the transport wheel 7 to prevent rotation of the transport wheel 7 in the counter-clockwise direction of FIG. 1. The springs of the reverse motion catch 29 engage behind the projections 45 as soon as the rotational angle of the transport wheel 7 corresponding to the transport step and thereby to the length of the label to be processed is reached. The separation of the pin 28 from the axis of the bore 39 and thereby from the axis of the transport wheel 7 assumes a value of approximately half the radius of the outer surface of the jacket 38 of the transport wheel 7.

In the event that the device is to be reconfigured for the processing of labels having a different length, it is only necessary for the connecting means 29 to be replaced by another connecting means with which the separation of the pin 28 from the axis of the bore 36 has a different dimension corresponding to the other transport step.

As shown in the preceding embodiments, the driver 27 carries out a back and forth motion which is transported to the connecting means 29 which, for its part, in the manner of a coupling having reverse motion catch, stepwise drives the transport wheel 7 in only one direction.

The pivot bolts 31 about which the flap 30 is pivotably mounted in the device floor 6 are, in embodiments of the invention, formed by bolts extruded onto the rollers 22 and made from the same material as the rollers, which pass through an associated bore 46 in the side portions of the flap to engage, in an appropriate pivoting mount, into the side portions 35 of the device floor 6. The flap 30 exhibits teeth 47 on its free end which serve for tearing off the carrier band 17 protruding out of the device.

I claim:

1. An apparatus for printing or dispensing of labels, the labels being bonded to a carrier band to form a label tape, the apparatus comprising:

a housing;

a supply roller for storing and feeding the label tape;

a deflection edge for detaching the labels travelling from the supply roller around the deflection edge from the carrier band;

a device floor pivotably mounted in the housing to pivot away from the housing;

a transport wheel for taking-up the label tape travelling from the deflection edge, the transport wheel rotating around an axis mounted in the device floor and having recesses;

connecting means pivotably mounted about the axis, the connecting means having resilient catches around a periphery which interlockingly engage in a drive direction of the transport wheel in the recesses of the transport wheel, the recesses and the resilient catches being adapted to engage only in a rotational direction of the transport wheel, the connecting means also having a pin projecting outward from the connecting means generally parallel to the axis, the pin having a radial separation from the axis which is less than a radius of the transport wheel;

a driver removably attached to the pin for urging the connecting means in the drive direction; and a hand lever cooperating with the driver to stepwise drive the driver.

2. The apparatus of claim 1, wherein the radial separation of the pin is about half the radius of the transport wheel.

3. The apparatus of claim 1, wherein the resilient catches comprise catch heads which cooperate with the recesses of the transport wheel, and resilient arms integral with the catch heads.

4.The apparatus of claim 3, wherein the connecting means has a middle piece and the resilient arms are integral with the middle piece and extend diagonally in an outward direction and in the drive direction of the transport wheel.

5. The apparatus of claim 1, wherein the recesses, the resilient catches, the pin, and the driver are adapted to drive the connecting means back and forth.

6. The apparatus of claim 1, further comprising a reverse motion catch adapted to engage the transport wheel to firmly hold the transport wheel during a return motion of the driver.

7. The apparatus of claim 1, further comprising:

a flap pivotally mounted to the device floor about a pivot axis to close the housing below the transport wheel.

8. The apparatus of claim 7, wherein the flap comprises a guide roller for the carrier band arranged about the pivot axis of the flap.

9. The apparatus of claim 7, wherein the flap is mounted in the device floor in a removable fashion.

10. The apparatus of claim 7, wherein the flap has a reverse motion catch for the transport wheel fashioned in a manner of a leaf spring on a side facing the transport wheel which cooperates with protrusions on the transport wheel.

11. The apparatus of claim 7, wherein the flap comprises at least one protrusion on a side facing the transport wheel for engagement at a periphery of the transport wheel to serve as a paper rejector.

12. The apparatus of claim 7, wherein the flap comprises teeth at a free end for tearing-off the carrier band.

13. The apparatus of claim 7, wherein the flap comprises a resilient catch which firmly holds the flap in a closed position in the device floor.

14. An apparatus for printing or dispensing of labels, the labels being bonded to a carrier band to form a label tape, the apparatus comprising:

a housing;

a supply roller for storing and feeding the label tape;

a deflection edge for detaching the labels travelling from the supply roller around the deflection edge from the carrier band;

a device floor pivotably mounted in the housing to pivot away from the housing;

a transport wheel for taking-up the label tape travelling from the deflection edge, the transport wheel rotating around an axis mounted in the device floor and having recesses;

connecting means pivotably mounted about the axis, the connecting means having resilient catches around a periphery which interlockingly engage in a drive direction of the transport wheel in the recesses of the transport wheel, the recesses and the resilient catches being adapted to engage only in a rotational direction of the transport wheel, the connecting means also having a pin projecting outward from the connecting means generally parallel to the axis, the pin having a radial separation from the axis which is less than a radius of the transport wheel;

a driver removably attached to the pin for urging the connecting means in the drive direction;

a hand lever cooperating with the driver to stepwise drive the driver; and a flap pivotably mounted to the device floor about a pivot axis to close the housing below the transport wheel.

15. An apparatus for printing or dispensing of labels, the labels being bonded to a carrier band to form a label tape, the apparatus comprising:

a housing;

a supply roller for storing and feeding the label tape;

a deflection edge for detaching the labels travelling from the supply roller around the deflection edge from the carrier band;

a device floor pivotably mounted in the housing to pivot away from the housing;

a transport wheel for taking-up the label tape travelling from the deflection edge, the transport wheel rotating around an axis mounted in the device floor and having recesses;

connecting means pivotably mounted about the axis, the connecting means having resilient catches around a periphery which interlockingly engage in a drive direction of the transport wheel in the recesses of the transport wheel, the recesses and the resilient catches being adapted to engage only in a rotational direction of the transport wheel, the connecting means also having a pin projecting outward from the connecting means generally parallel to the axis, the pin having a radial separation from the axis which is less than a radius of the transport wheel;

a driver removably attached to the pin for urging the connecting means in the drive direction;

a hand lever cooperating with the driver to stepwise drive the driver; and a flap pivotably mounted to the device floor about a pivot axis to close the housing below the transport wheel, the flap having a reverse motion catch for the transport wheel fashioned in a manner of a leaf spring on a side facing the transport wheel and cooperating with protrusions on the transport wheel.

* * * * *